US005735316A

United States Patent [19]

Hehle

[11] Patent Number: 5,735,316

[45] Date of Patent: Apr. 7, 1998

[54] AIR WEAVING LOOM INCLUDING A LEADING END WEFT STRETCHER AND METHOD FOR INSERTING A WEFT THREAD INTO A WEFT INSERTION CHANNEL OF THE LOOM

[75] Inventor: Josef Hehle, Hoerbranz, Austria

[73] Assignee: Lindauer Dornier Gesellschaft mbH, Lindau, Germany

[21] Appl. No.: 761,852

[22] Filed: Dec. 9, 1996

[30] Foreign Application Priority Data

Dec. 8, 1995 [DE] Germany ..... 195 45 839.7

[51] Int. Cl.[6] ..... D03D 47/30

[52] U.S. Cl. ..... 139/194; 139/302; 139/370.2; 139/430

[58] Field of Search ..... 139/430, 434, 139/194, 302, 370.2

[56] References Cited

U.S. PATENT DOCUMENTS

| | | | |
|---|---|---|---|
| 3,744,533 | 7/1973 | Yano et al. | 139/430 |
| 3,901,286 | 8/1975 | Vermeulen et al. | 139/194 |
| 4,453,572 | 6/1984 | Key | 139/430 |
| 4,498,504 | 2/1985 | Allen et al. | 139/430 |
| 4,549,582 | 10/1985 | Kung et al. | 139/430 |
| 4,607,667 | 8/1986 | Gibson | 139/302 |
| 4,967,807 | 11/1990 | Lewyille et al. | 139/194 |
| 5,040,570 | 8/1991 | Shaw | 139/430 |
| 5,224,521 | 7/1993 | De Jagger | 139/194 |
| 5,226,453 | 7/1993 | Bamelis | 139/194 |

*Primary Examiner*—Andy Falik
*Attorney, Agent, or Firm*—W. G. Fasse; W. F. Fasse

[57] ABSTRACT

An air nozzle weaving loom is equipped on its weft exit sides (E2) with a cutter (11), a suction opening (8A), a first weft stop motion sensor (4), a weft stretcher (6), and a second weft stop motion sensor (7) arranged in that order in the weft insertion direction. These components are operated to provide a complete monitoring and handling of the weft thread with regard to proper weft thread insertions. A control signal from the first weft stop motion device (4) activates a suction device (8, 9) connected to said suction opening (8A) while simultaneously deactivating the stretcher (6), when the leading end of the weft thread reaches the first weft stop motion device (4). The cutter is activated by the main loom control while the suction is applied to the suction opening (8A), whereby a cut off leading end (16A) of the weft thread (16) is removed by suction. Thus, auxiliary warp threads and the formation of a so-called catch selvage are avoided and an auxiliary reed for forming the catch selvage is not nesessary.

7 Claims, 2 Drawing Sheets

AIR WEAVING LOOM INCLUDING A LEADING END WEFT STRETCHER AND METHOD FOR INSERTING A WEFT THREAD INTO A WEFT INSERTION CHANNEL OF THE LOOM

FIELD OF THE INVENTION

The invention relates to air jet weaving looms and to a method for the insertion of the weft threads into the weft insertion channel of the reed.

BACKGROUND INFORMATION

In conventional air jet weaving looms so-called auxiliary warp threads are used in addition to the main warp threads. The auxiliary warp threads are woven into an auxiliary or so-called catch selvage which must then be cut off, resulting in substantial waste. Besides, forming of the catch selvage requires an auxiliary reed for guiding the auxiliary warp threads. The auxiliary reed takes up space that may be more effectively used for other loom components. Further, a spacing must be provided between the fabric warp threads and the auxiliary selvage warp threads. That spacing, as viewed in the weft insertion direction may be larger or smaller, but cannot be avoided conventionally since it must be at least large enough to accommodate a so-called reacher-in device and a weft cutter for cutting off the auxiliary selvage. The reacher-in device then forms the normal selvage with the cut weft ends protruding from the fabric. The purpose of the auxiliary warp threads is to pick-up the leading end of the weft thread and make sure that the weft thread remains tensioned and can be properly severed by the weft cutter. The stretching itself or proper tensioning of the weft thread is achieved conventionally with a so-called stretching nozzle which seizes the leading weft end as it emerges from the weft insertion channel exit end keeps the weft thread under tension as long as the stretching nozzle remains active.

The auxiliary or catch selvage normally has a width in the weft insertion direction of several centimeters. Once the auxiliary or catch selvage has served its purpose, it becomes waste which can become quite substantial and must be disposed of, not to mention the increased material consumption for warp and weft threads, thereby making the fabric more expensive than would be otherwise necessary.

OBJECTS OF THE INVENTION

In view of the above it is the aim of the invention to achieve the following objects singly or in combination:

to provide a method and an air jet weaving loom for the insertion of the weft threads into the weft insertion channel of the loom reed in such a way that the use of a catch selvage is no longer necessary;

to save the auxiliary warp threads that have been wasted heretofore in the auxiliary or catch selvage and to optimally reduce the length of the leading cut-off end of the weft threads;

to make the length of the fabric spreader independent of the fabric width so that one fabric spreader with a fixed width can be used for different fabric widths on the same loom; and to use the available space or the gained space at the exit side of the loom more efficiently for the positioning of weft insertion and handling components.

SUMMARY OF THE INVENTION

The method according to the invention is characterized by the steps of activating a suction device (8) and simultaneously deactivating a weft stretcher (6) with the help of a weft stop motion device (4) that provides a control signal for performing the above steps in response to the proper insertion of a weft thread into the weft insertion channel of the loom reed. Once the leading weft thread end (16A) is free of the effect of the stretcher (6) and seized by the suction of the suction device (8), a cutter (11) is activated by the loom control and the cut-off leading weft end (16A) is removed by the suction of the suction device.

The weft stretcher (6) and the cutter (11) are activated by a control signal from a general loom control, not shown, in accordance with the loom control timing for these weft handling components (6) and (11). The timing is such that after the leading end (16A) of the weft thread (16) has been gripped by suction effective through an opening (8A) in response to the control signal from the weft stop motion device (4), the weft thread is cut by cutter (11) so that the cut-off leading weft thread portion can be transported away by the suction device (8). The air jet weaving loom according to the invention for performing the above steps of the present weft handling method is characterized in that suction opening (8A) of the suction device (8) is positioned to be effective in the weft insertion channel (1A) upstream of the above mentioned weft stop motion device (4), as viewed in the weft insertion direction when the reed (1) with its weft insertion channel is in the weft beat-up, forward position. A further weft stop motion device (7) is only effective when a weft break or insertion failure occurs.

It is an important feature and advantage of the invention that the use of so-called catch selvages is completely avoided by the use of a suction device which is effective with its suction opening in the area of a "reacher-in" device for forming a normal selvage without the formation of any auxiliary or catch selvage.

The suction device (8, 8A) according to the invention is positioned in the space that has now become available by the omission of the catch selvage between the reacher-in head (3) and the weft cutter (11) on the one hand, and the first weft stop motion device (4).

It is the purpose of the suction device (8) according to the invention to take over the leading end of the weft thread that has been seized and stretched by the stretcher (6), such as a blower nozzle, when a weft thread (16) has been fully and properly inserted. The present suction device (8) after taking over the leading weft thread end (16A) keeps the latter tensioned so that the leading weft thread end can be cut by the respective weft cutter (11), whereupon the cut-off thread end is transported away by the suction device.

The avoidance of auxiliary warp threads and thus catch selvages results in substantial savings of warp thread and materials and thus of production costs. By gaining space due to the avoidance of the catch selvages the suction opening in the weft insertion channel can be positioned where it is most effective, namely directly upstream of the first weft stop motion device (4), and it is not necessary to forego other important loom components due to lack of space.

Still an other advantage of the invention is seen in that the fabric spreader that heretofore had to be adapted in its length to the required or desired fabric width, can now be constructed to extend over the entire loom width without any adaptation to the width of any particular fabric being woven.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
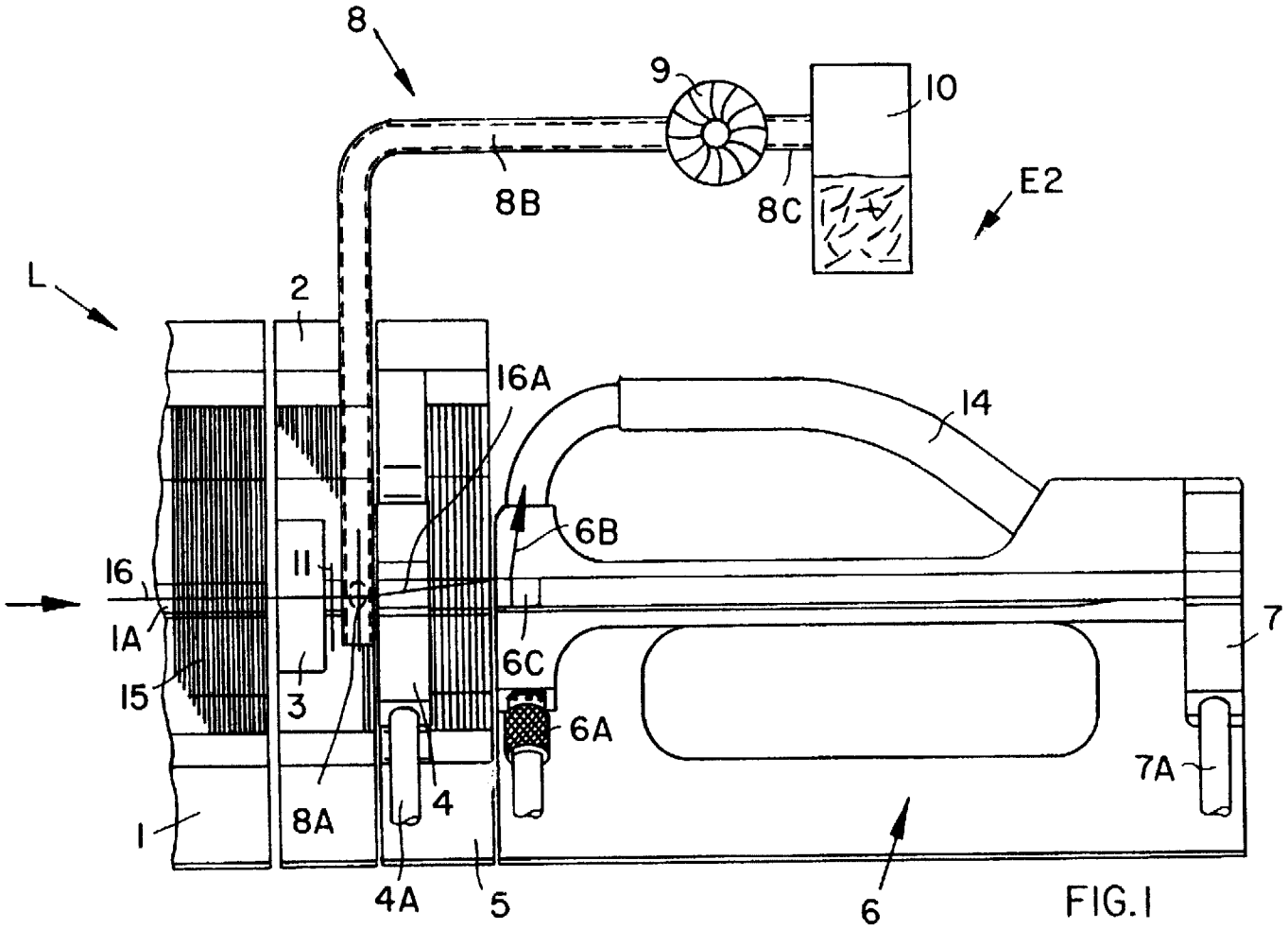
FIG. 1 shows a schematic front view of the exit end of a reed of an air jet loom according to the invention.

FIG. 1 shows the exit end E2 of a reed 1 in an air jet weaving loom L. A multitude of warp threads 15 run through the reed 1 for the formation of a shed 19. A spacer reed section 2 is arranged downstream of the reed 1 as viewed in the feed advance direction of a weft thread 16 from left to right through a weft insertion channel 1A formed in the reed 1 and in the spacer reed section 2. A first weft stop motion device 4 for monitoring the arrival of a leading end 16A of a weft thread 16 downstream of the spacer reed section 2, is mounted on support 5 downstream of the spacer reed section 2. It is the purpose of the spacer reed section 2 to lengthen the weft insertion channel 1A of the reed 1 just sufficiently to assure a proper weft thread insertion. A reacher-in device 3 is positioned in the plane of the spacer reed section 2. The reacher-in device 3 may form a conventional selvage. A first weft cutter 11 is mounted downstream of the reacher-in device 3. According to the invention a suction opening 8A is positioned to he effective in the weft insertion channel 1A downstream of the cutter 11 but upstream of the first weft stop motion device 4 mounted on the support or bracket 5 followed by a weft stretcher 6 including a nozzle or blow hole 6A for blowing a stretcher flow 6B into a channel 14 through a hole 6C for seizing and stretching a leading end 16A of a weft thread 16 into the channel 14. A further weft stop motion device 7 is arranged downstream of the stretcher member 6 for providing a further control signal only if a weft break or weft insertion failure has occurred.

According to the invention a suction pump 9 of a suction device 8 is connected to the suction opening 8A effective in the weft insertion channel of the reacher-in device 3 by a pipe or hose 8B positioned between the cutter 11 and the first weft stop motion device 4. The output of the vacuum pump 9 is connected through a discharge duct 8C to a collection bin 10 for collecting cut-off leading ends 16A of weft threads. For this purpose the cutter 11 is positioned directly upstream of the suction hole 8A. Wire or cable ducts 4A and 7A, are connected to the respective weft stop motion devices 4 and 7.

Figure 2:
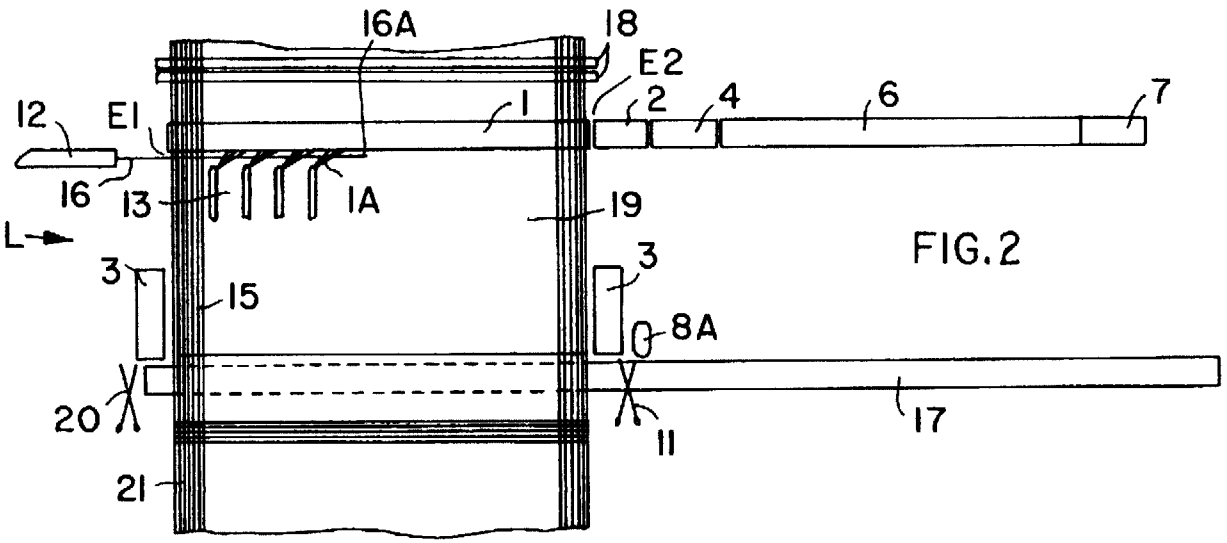
FIG. 2 is a schematic top plan view of a loom according to the invention with its reed shown in the rear or return position.
Figure 3:
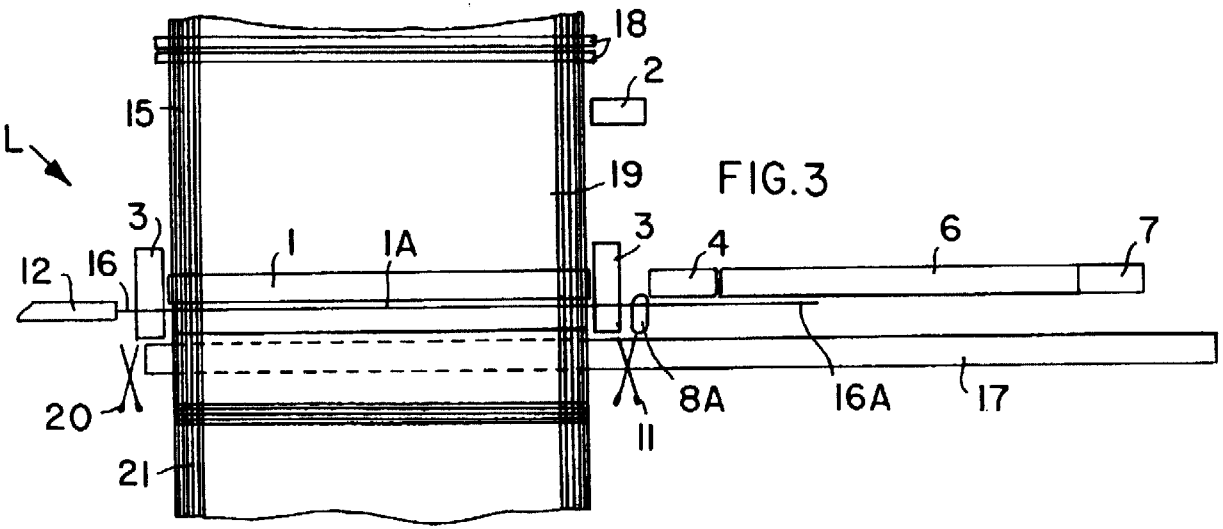
FIG. 3 is a view similar to that of FIG. 2, but showing the reed in the forward or weft beat-up position.

Referring to FIGS. 2 and 3, the loom according to the invention is operated in accordance with the present method as follows. The plan views of FIGS. 2 and 3 show a head shaft 18 above the reed 1 shown in its weft insertion rear position in FIG. 2 and in its weft beat-up position in FIG. 3. A weft insertion nozzle on the entrance side E1 of the reed 1 blows a weft thread 16 into the weft, insertion channel 1A of the reed 1, whereby auxiliary nozzles 13 complete the transport of the weft thread 16 with its leading end 16A through the insertion channel including through the insertion channel extension provided in the spacer reed section 2. A second cutter 20 severs the trailing end of the inserted weft thread from the weft supply. If there is no weft break or weft insertion failure, the leading end 16A is transported until the leading end 16A triggers the generation of a control signal in the weft stop motion device or sensor 4. This signal activates the suction device 8, 9 and simultaneously deactivates the stretcher 6, whereby the leading end 16A of the weft thread 16 can be seized by the suction through the opening 8A and transported into the bin 10.

The foregoing steps take place after the reed 1 has performed a beat-up motion because during beat-up a properly inserted weft thread must be kept taut by the stretcher 6. As soon as a beat-up is completed, the cutter 11 is activated by a signal from the main loom control not shown, and the suction now generated by the device 8 seizes the leading end 16A of the weft thread 16 through the opening 8A and the cut off end of the weft thread is transported into the collecting bin 10.

The weft thread end protruding from the fabric edge is now handled by the reacher-in device 3 for tucking this protruding end into the fabric selvage with the next beat-up motion, whereby a normal selvage is formed along the fabric 21 without the formation of any catch selvage.

As shown in FIGS. 2 and 3, a fabric spreader or fabric guide 17 extends over the entire weaving width of the loom, whereby the guide or spreader 17 is effective for any actual intermediate weaving width.

Although the invention has been described with reference to specific example embodiments, it will be appreciated that it is intended to cover all modifications and equivalents within the scope of the appended claims.

What is claimed is:

1. A method for inserting a weft thread into a weft insertion channel (1A) having an entrance (E1) and an exit (E2) in a reed (1) of an air nozzle weaving loom (L), comprising the following steps:

(a) blowing a weft thread (16) into and through said weft insertion channel (1A) from said entrance (E1) to said exit (E2), (b) stretching said weft thread on its way through said weft insertion channel, (c) monitoring the arrival of said weft thread with a weft stop motion device (4), (d) activating a suction device (8, 8A, 9) positioned upstream of said weft stop motion device (4) as viewed in the weft insertion direction, in response to a signal from said weft stop motion device (4), (e) simultaneously deactivating said stretching of said weft thread in response to said signal from said weft stop motion device (4), (f) seizing a leading end (16A) of said weft thread (16) by said suction device (8A), (g) cutting off said leading weft thread end (16A), and (h) transporting away a cut-off leading weft thread end (16A) by said suction device (8, 8A, 9), whereby auxiliary warp threads and a catch selvage are avoided.

2. The method of claim 1, wherein said activating step comprises connecting said suction nozzle (8) to vacuum pump (9).

3. The method of claim 1, further comprising seizing any weft thread portion protruding, after said cutting-off step, from a fabric being woven, and inserting said weft thread portion into a next following loom shed.

4. An air nozzle weaving loom (L), comprising a reed (1) with a weft insertion channel (1A) having a weft entrance and a weft exit, one or more weft insertion nozzles (12, 13) for transporting a weft thread (16) through said weft insertion channel (1A), a weft stretcher (6) at said weft exit (E2), a weft stop motion device (4) positioned upstream of said weft stretcher (6) as viewed in the weft insertion direction, for providing a control signal for deactivating said weft stretcher (6), a suction device (8, 8A, 9) having a suction opening (8A) effective in said weft insertion channel (1A) upstream of said weft stop motion device (4), said control signal activating said suction device while deactivating said stretcher (6), a weft cutter (11) positioned upstream of said suction opening (8A) for cutting off a leading end (16A) of said weft thread (16), whereby a leading end (16A) of a properly inserted weft thread (16) is transported away by said suction device and formation of a catch selvage is avoided.

5. The air nozzle weaving loom of claim 4, wherein said suction device comprises a vacuum pump (9) and connections (8B) connecting said vacuum pump (9) to said suction opening (8A).

6. The air nozzle weaving loom of claim 5, further comprising a container (10) connected to said vacuum pump (9) for collecting cut-off weft thread ends.

7. The air nozzle weaving loom of claim 4, further comprising a fabric spreader (17) having a length extending along the entire weaving width of said loom.

* * * * *

UNITED STATES PATENT AND TRADEMARK OFFICE
CERTIFICATE OF CORRECTION

PATENT NO. : 5,735,316
DATED : Apr. 7, 1998
INVENTOR(S) : Hehle

It is certified that error appears in the above-identified patent and that said Letters Patent is hereby corrected as shown below.

On the title page, under [54], line 5, after "CHANNEL" delete "OF THE LOOM";

| | | |
|---|---|---|
| Col. 1, | line 5, | after "CHANNEL" delete "OF THE LOOM"; |
| Col. 2, | line 58, | after "Still" replace "an other" by --another--; |
| Col. 3, | line 29, | after "device" replace "3," by --3.--; |
| | line 49, | before "are" replace "7A," by --7A--; |
| | line 53, | after "a" replace "head" by --heald--; |
| | line 57, | after "the" replace "weft," by --weft--; |

Signed and Sealed this

Seventh Day of July, 1998

Bruce Lehman

*Attest:*

BRUCE LEHMAN

*Attesting Officer*

*Commissioner of Patents and Trademarks*